US006273610B1

(12) United States Patent
Koyama et al.

(10) Patent No.: US 6,273,610 B1
(45) Date of Patent: Aug. 14, 2001

(54) PACKAGE FORMED OF SOFT SHEET

(75) Inventors: Yasuhiro Koyama; Takeshi Bando; Yukiko Iida; Ikuya Saitou, all of Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 0 days.

(21) Appl. No.: 09/575,015

(22) Filed: May 19, 2000

(30) Foreign Application Priority Data

May 24, 1999 (JP) ..... 11-143040

(51) Int. Cl.[7] ..... B65D 30/08; B65D 33/16

(52) U.S. Cl. ..... 383/207; 206/494; 229/125.35; 229/169; 229/245; 229/122.2; 383/210; 383/42; 383/66; 383/67

(58) Field of Search ..... 383/211, 210, 383/207, 208, 66, 67, 42; 229/125.35, 245, 169, 122.2; 206/494

(56) References Cited

U.S. PATENT DOCUMENTS

| | | | | |
|---|---|---|---|---|
| 2,736,656 | * | 2/1956 | Marshall | 229/125.35 |
| 2,990,948 | * | 7/1961 | Zackheim | 229/125.35 |
| 3,454,210 | * | 7/1969 | Spiegel et al. | 229/125.35 |
| 3,615,712 | * | 10/1971 | Keller | 383/207 |
| 3,717,533 | * | 2/1973 | Mayworm et al. | 229/125.35 |
| 3,783,089 | * | 1/1974 | Hurst et al. | 229/125.35 |
| 3,863,832 | * | 2/1975 | Gordon et al. | 229/125.35 |
| 3,865,302 | * | 2/1975 | Kane | 229/125.35 |
| 3,917,155 | * | 11/1975 | Bemiss | 229/169 |
| 3,924,803 | * | 12/1975 | de Habsburg | 229/87.08 |
| 4,292,332 | * | 9/1981 | McHam | 426/111 |
| 4,308,985 | * | 1/1982 | Manizza et al. | 229/125.35 |
| 4,338,766 | | 7/1982 | Hamilton | 53/456 |
| 4,427,148 | * | 1/1984 | Seiter et al. | 229/125.35 |
| 4,610,357 | * | 9/1986 | Nakamura | 206/449 |
| 4,651,874 | * | 3/1987 | Nakamura | 206/205 |
| 4,656,068 | * | 4/1987 | Raines | 428/35 |
| 4,694,960 | | 9/1987 | Phipps | 206/469 |
| 4,723,301 | * | 2/1988 | Chang | 383/66 |
| 4,771,935 | * | 9/1988 | Hekal | 229/125.35 |
| 4,784,885 | * | 11/1988 | Carespodi | 428/36.8 |
| 4,840,270 | * | 6/1989 | Caputo et al. | 206/205 |
| 4,848,575 | * | 7/1989 | Nakamura et al. | 206/449 |
| 4,903,837 | * | 2/1990 | Duello | 206/440 |
| 4,915,289 | * | 4/1990 | Hatano et al. | 229/123.1 |

(List continued on next page.)

FOREIGN PATENT DOCUMENTS

0834782A1 4/1998 (EP) .

*Primary Examiner*—Stephen P. Garbe
(74) *Attorney, Agent, or Firm*—Darby & Darby

(57) ABSTRACT

There is disclosed a package including a box body having an opening and a cover member for closing the opening of the box body. The box body is formed of a packaging material of a soft sheet having a monolayer of a resin film or a multi-layer structure having a resin film. The box body includes: a rectangular bottom face portion; four side face portions folded from the four sides of the bottom face portion; corner sealing portions formed by jointing the inner faces of the side face portions at corner portions between the adjoining side face portions; flange portions folded outward of the box body from the upper ends of the side face portions substantially at a right angle thereto and with a predetermined width size; and flange jointing portions jointing the flange portions folded from the side face portions without any clearance between each other at the upper ends of the corner portions between the adjoining side face portions. The cover member is formed of a packaging material of a soft sheet having a monolayer of a resin film or a multi-layer structure having a resin film. The cover member is jointed to the upper surfaces of the flange portions and the flange jointing portions which are formed continuously along the upper ends of the side face portions and the upper ends of the corner portions.

11 Claims, 9 Drawing Sheets

U.S. PATENT DOCUMENTS

| | | | | |
|---|---|---|---|---|
| 4,998,669 | * | 3/1991 | Karolyi | 229/170 |
| 5,062,569 | * | 11/1991 | Hekal | 229/125.35 |
| 5,160,767 | * | 11/1992 | Genske | 428/35.98 |
| 5,244,145 | * | 9/1993 | Forbes, Jr. | 229/125.35 |
| 5,409,116 | | 4/1995 | Aronsen | 206/484 |
| 5,433,374 | * | 7/1995 | Forbes, Jr. | 229/125.35 |
| 5,445,454 | * | 8/1995 | Barkhorn | 383/207 |
| 5,516,035 | * | 5/1996 | Stone | 229/123.2 |
| 5,660,322 | | 8/1997 | Jensen | 229/193 |
| 5,664,670 | | 9/1997 | Cozzie | 206/216 |
| 6,113,271 | * | 9/2000 | Scott et al. | 383/211 |

* cited by examiner

PACKAGE FORMED OF SOFT SHEET

BACKGROUND OF THE INVENTION

1. Field of the Invention

The present invention relates to a package of a soft sheet for packaging a content such as dry tissues, wet tissues, wipes, sanitary napkins, granular articles, foods or the like or even liquids.

2. Related Art

The package of the soft sheet is generally exemplified by a lengthwise pillow type. FIG. 11 is a perspective view showing the lengthwise pillow type package of the prior art for packaging wet tissues.

The package shown in FIG. 11 is manufactured by: jointing the edge portions of packaging materials (1) of a soft sheet having laminated aluminum foils and resin films in a joining state to form a longitudinal sealing portion in a cylindrical shape; and sealing the two longitudinal end portions of the cylindrical packaging material (1) to form side sealing portions (2) and (3). Generally, with one side sealing portion (2) being formed, the packaging material (1) is charged with a content from the other opening, and this opening is closed to form the side sealing portion (3).

The package shown in FIG. 11 is formed with an opening (4) in a portion of the packaging material (1), and the wet tissues (5) as the content can be taken out one by one from the opening (4). The opening (4) is covered with a cover sheet (6). The cover sheet (6) is adhered to the surface of the packaging material (1) through an adhesive layer which can be repeatedly peeled and adhered. The package can be air-tightly sealed by closing the opening (4) with the cover sheet (6), when the wet tissues (5) is not to be taken out.

In the package shown in FIG. 11, the so-called "gusset folds" (7, 7) are formed on the two sides of the side sealing portions (2) and (3). The height size of the package becomes so gradually thinner at the gusset folds (7, 7) as to merge into the side sealing portions (2) and (3). When a cubic content such as stacked wet tissues is packaged, therefore, it cannot be accommodated in a portion of a size L containing the gusset folds (7, 7). This makes the entire volume of the package larger than the content volume. In the longitudinal direction of the package, moreover, the side sealing portions (2) and (3) protrude to enlarge the outer size of the package more.

As a result, there arises a problem that when a small-sized package for packaging a stack of small-folded wet tissues (5) is to be formed, the size of the entire package cannot be sufficiently reduced.

On the other hand, if a package is formed into the box shape for packaging the cubic content, no wasteful space is left in the package, and the large projections such as the side sealing portions (2) and (3) can be eliminated.

The box-shaped package of this kind can be formed by vacuum- or pressure-forming a hard PET resin sheet. However, this forming method requires a forming step using a mold so that it raises the cost. Since the emptied package is hard, moreover, it increases the volume of waste when disposed.

In the food packaging field, on the other hand, there exists a package which is formed from paper into a box shape. However, this paper package has its strength lost when charged with a wet content.

SUMMARY OF THE INVENTION

According to the invention, there is provides a package comprising a box body having an opening and a cover member for closing the opening of the box body, the box body being formed of a packaging material of a soft sheet having a monolayer of a resin film or a multi-layer structure having a resin film and having:

(a) a rectangular bottom face portion;

(b) four side face portions folded from the four sides of the bottom face portion;

(c) corner sealing portions formed by jointing the inner faces of the side face portions at corner portions between the adjoining side face portions;

(d) flange portions folded outward of the box body from the upper ends of the side face portions substantially at a right angle thereto and with a predetermined width size; and (e) flange jointing portions jointing the flange portions folded from the side face portions without any clearance between each other at the upper ends of the corner portions between the adjoining side face portions, the cover member being formed of a packaging material of a soft sheet having a monolayer of a resin film or a multi-layer structure having a resin film and jointed to the upper surfaces of the flange portions and the flange jointing portions which are formed continuously along the upper ends of the side face portions and the upper ends of the corner portions.

For example, the corner sealing portions as mentioned at (c) above may be formed to extend along the corner portions between the adjoining side face portions with a predetermined width size, and in the flange jointing portions as mentioned at (e) above, jointed sealing portions may be formed continuing to the corner sealing portion, so that each jointed sealing portion extends from the corner portion outward of the box body at an obtuse angle to the respective side face portions adjoining to each other and joins the flange portions of the adjoining side face portions. Here, if the width sizes of the flange portions are the same, the jointed sealing portion has an angle of about 135° to the respective side face portions.

Preferably, at least the inner surface of the box body is formed of a weldable packaging material so that the aforementioned sealing portions are formed by a heat sealing method, an ultrasonic sealing method or a high-frequency sealing method. Alternatively, the sealing portions may be formed by adhering the overlapping surfaces of the soft sheet together with e.g., a hot-melt adhesive.

The packaging material of the soft sheet of the box body may be of higher rigidity than the packaging material of the cover member, and the cover member may be jointed to the flange portions and the flange jointing portions by an easy peeling type sealant layer.

The cover member may be formed with perforations along which the cover member can be torn to open the package.

Alternatively, the cover member may be formed with an opening, and a cover sheet for closing the opening of the cover member may be adhered to the surface of the cover member repeatedly separably therefrom.

As a further alternative, the box body may be formed at the bottom face portion with an opening from which the content can be taken out so that the package is to be used while the cover member is directed downward. In this case, preferably, a cover sheet for closing the opening formed at the bottom face portion is adhered to the surface of the bottom face portion repeatedly separably therefrom.

One flange portion folded from any one of the side face portions may be larger in width size than the other flange portions, and the flange portion with a larger width size may be holed or slotted to form a hook portion.

A plurality of box bodies may be connected to one another through the flange portions. In this case, perforations are preferably formed between the connected flange portions for facilitating the separation of the box bodies.

DESCRIPTION OF THE PREFERRED EMBODIMENTS

Figure 2:
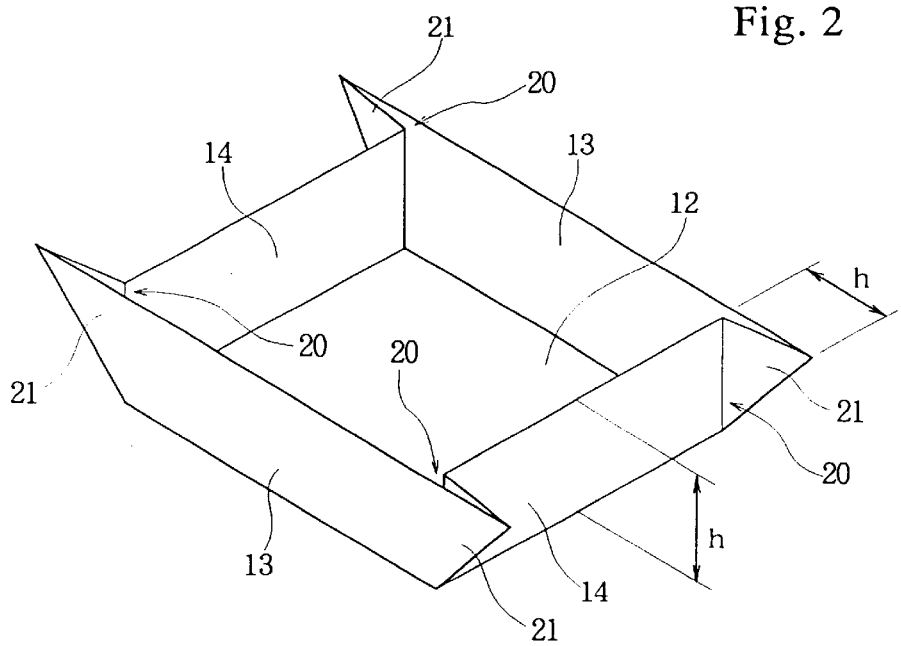
FIG. 2 is a perspective view showing the state in which a packaging material is folded to form side face portions and folded projections when a package according to one embodiment of the invention is manufactured.
Figure 3:
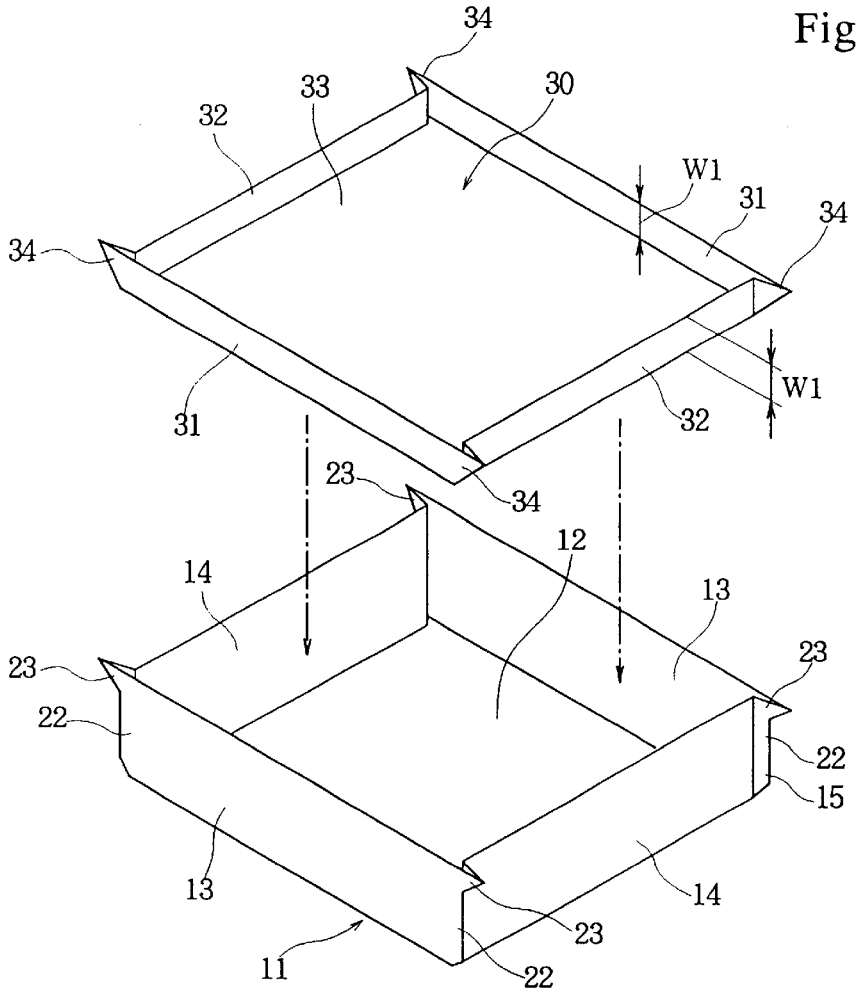
FIG. 3 is a perspective view showing the state in which a cover member having four folded sides is laid over a box body.
Figure 4:
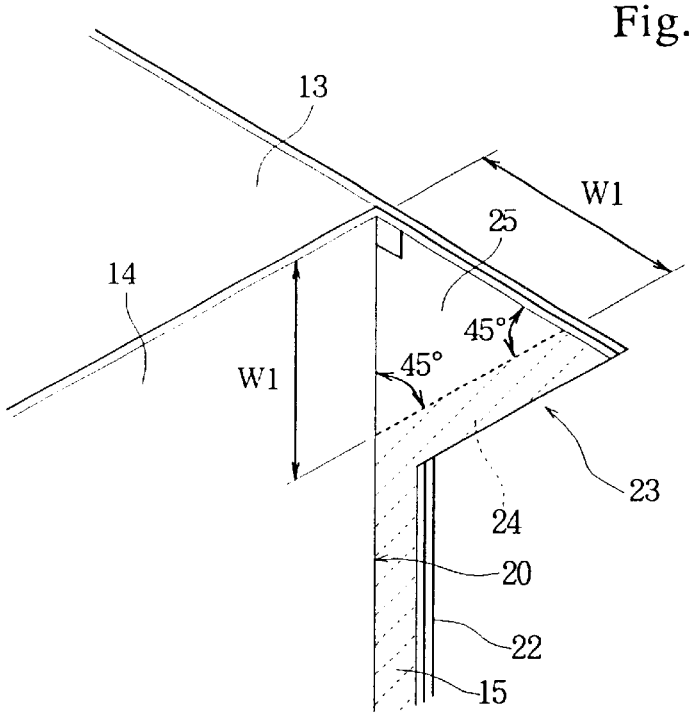
FIG. 4 is a perspective view showing a structure of a flange jointing portion before developed.
Figure 5:
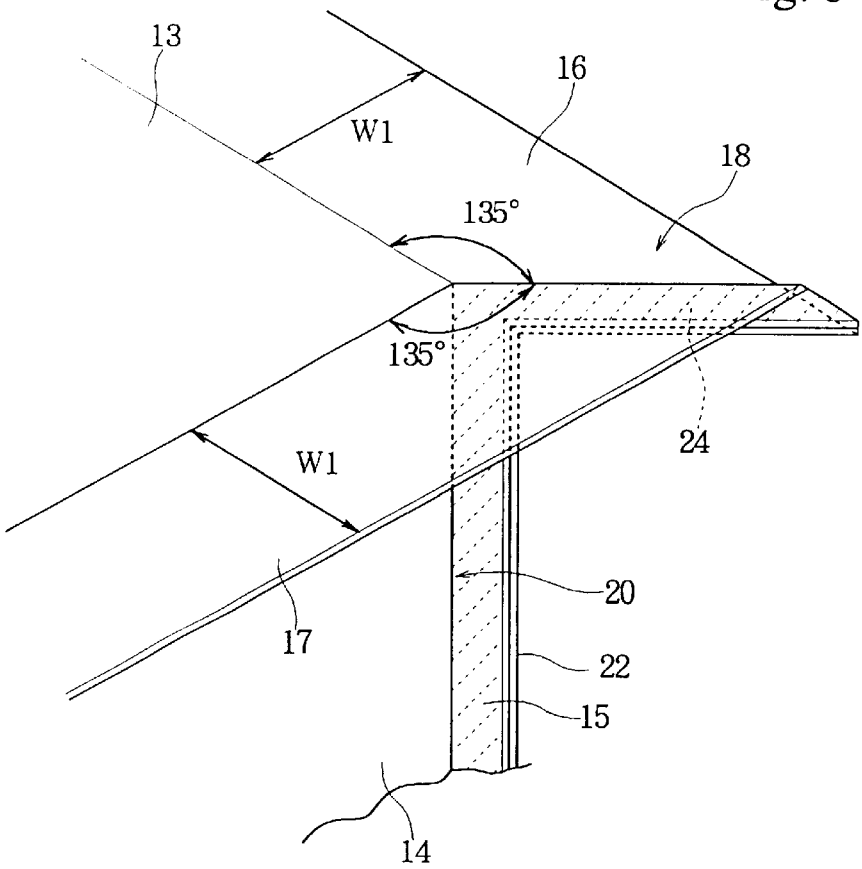
FIG. 5 is a perspective view showing the flange jointing portion after developed.

FIGS. 1A, 1B, 2 and 3 are perspective views showing a process for manufacturing a package of a soft sheet according to one embodiment of the invention, and FIGS. 4 and 5 are perspective views showing a structure of a flange jointing portion.

Figure 1A:
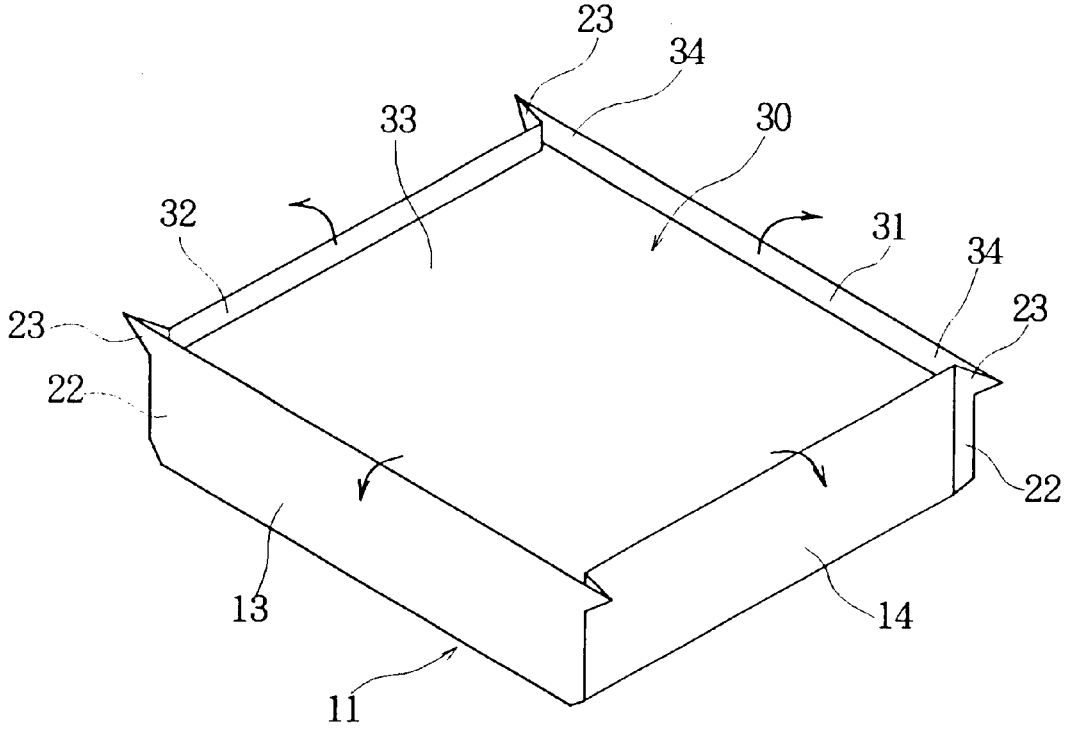
FIG. 1A is a perspective view showing the state in which flange portions of a package according to one embodiment of the invention are not developed.
Figure 1B:
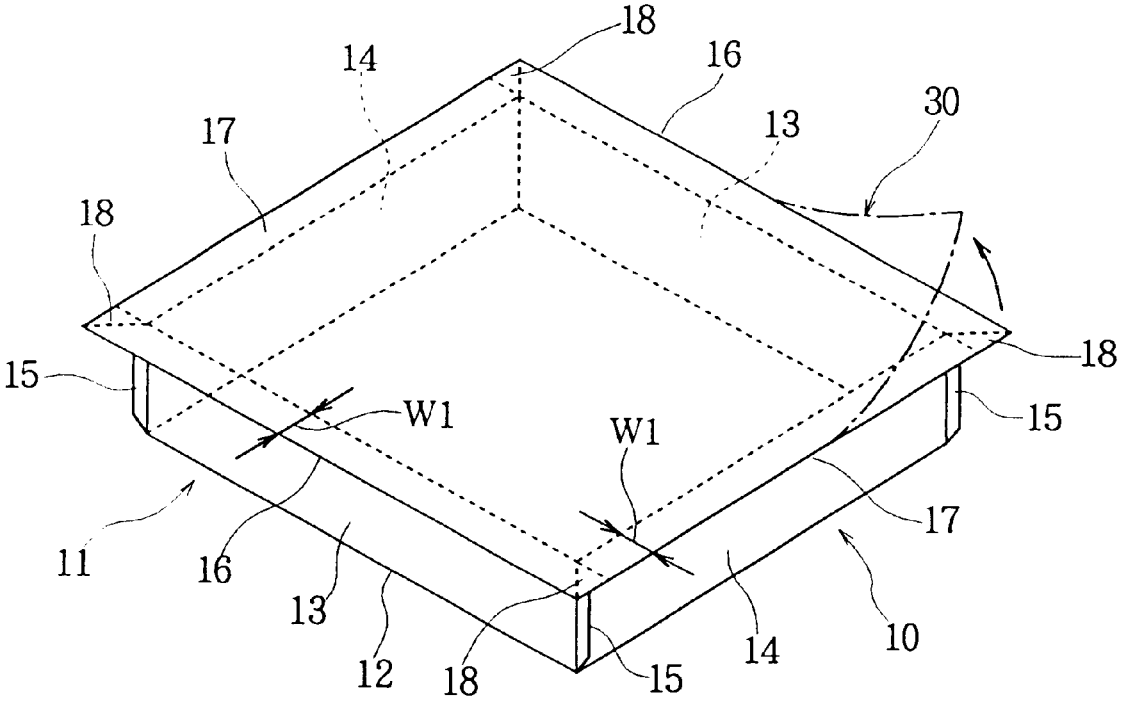
FIG. 1B is a perspective view showing the state in which flange portions of a package according to one embodiment of the invention are developed.

FIG. 1B shows a completed state of a package (10), as formed of a soft sheet, according to one embodiment of the invention.

This package (10) is constructed to include a cubic or prism-shaped box body (11), and a cover member (30) for covering the opening of the box body (11).

The box body (11) is formed of a packaging material of a soft sheet. This packaging material has a monolayer structure of a resin film or a multi-layer structure including a resin film. The monolayer packaging material is exemplified by a resin film such as high density polyethylene, low density polyethylene, polypropylene, polyethylene terephthalate or nylon, and the multi-layer packaging material is exemplified by a laminate material formed of any combination of the aforementioned monolayer resin films. In use for wrapping food, on the other hand, the packaging material may be a multi-layer film having the so-called "gas barrier properties" and containing polyvinylidene chloride or ethylene-vinyl acetate copolymer. Alternatively, the packaging material may be a laminate of a net-shaped split clock (for example, a sheet formed by interposing a net-shaped material between two non-woven fabrics and subjecting it to a water jetting treatment) and any of the aforementioned resin films. For a wet content, on the other hand, there may be preferably used a laminate of a resin film of polyethylene and/or polypropylene and a metal foil such as aluminum foil, or a resin film of a polyethylene or polyester deposited with silica or a metal layer of aluminum.

On the other hand, the cover member (30) may also be formed of the same monolayer film or multi-layer soft sheet as that of the box body (11).

Here, the "soft sheet" forming the box body (11) and the cover member (30) means such a flexible packaging material as can be folded or crushed and can be disposed of as a waste when emptied of its content.

The box body (11) and the cover member (30) may be formed of sheet materials of the same rigidity, but the box body (11) may be formed of a packaging material of a soft sheet more rigid than that of the soft sheet making the cover member (30). In this case, the box body (11) has an excellent shape retention when filled with the content. If the cover member (30) having an easy peeling type sealant layer on its portion to face the box body (11) is employed and heat-sealed to the box body (11), on the other hand, it can be easily peeled off the box body (11) with fingers, as indicated by broken lines in FIG. 1B.

The box body (11) is formed to have a rectangular bottom face portion (12), side face portions (13, 13) folded at a right angle from the two longer sides of the bottom face portion (12), side face portions (14, 14) folded at a right angle from the two shorter sides of the bottom face portion (12), and corner sealing portions (15) for jointing the adjoining ones of the side face portions (13) and the side face portions (14) to each other at the corners, while leaving an upward opening.

On the other hand, the upper portions of the side face portions (13, 13) are folded generally at a right angle outward of the box body (11) to form flange portions (16, 16), and the upper portions of the side face portions (14, 14) are likewise folded generally at a right angle outward of the box body (11) to form flange portions (17, 17). Over the corners between the side face portions (13) and the side face portions (14), on the other hand, there are formed flange jointing portions (18) at which the flange portions (16, 16) and the flange portions (17, 17) are jointed without any clearance.

As a result, all the flange portions (16, 16), the flange portions (17, 17) and the four flange jointing portions (18) are so formed throughout the periphery of the four sides of the upward opening of the box body (11) as to form a plane parallel to the bottom face portion (12). Moreover, the cover member 30 is jointed through an easy peeling type sealant layer, for example, to the upper faces of the flange portions (16, 16), the flange portions (17, 17) and the four flange jointing portions (18).

The width size of the flange portions (16, 16) folded over the side face portions (13, 13) may be different from that of the flange portions (17, 17) folded over the side face portions (14, 14). If the width sizes are equalized or substantially equalized to a value (W1), however, the individual flange portions and the flange jointing portions (18) can be easily formed, as will be described hereinafter.

Here will be described one example of a process for manufacturing the package (10).

First of all, as shown in FIG. 2, one soft sheet is formed into the rectangular bottom face portion (12), and the side face portions (13, 13) and the side face portions (14, 14) rising perpendicularly from the four sides of the bottom face portion (12). At this time, a triangular folded projecting portion (21) is formed at each of corner portions (20) between the side face portions (13) and the side face portions (14). A projection size (h) of the folded projecting portion (21) from the corner portion (20) is equal to the height size (h) of each of the side face portions (13) and the side face portions (14). Thus, the folded projecting portion (21) has a shape of the right-angled isosceles triangle.

Next, the folded projecting portions (21) of the right-angled isosceles triangle are adhered on their inner faces to each other. As shown in FIG. 3, moreover, the folded projecting portions (21) are so partially cut off as to leave narrow portions (22) extending along the corner portions (20) and small trianglar portions (23) over the narrow portions (22).

FIG. 4 shows the narrow portion (22) and the small triangular portion (23) in an enlarged scale. A region, as hatched by broken lines in FIG. 4, indicates a portion at which the packaging materials of the soft sheet are adhered to each other. In the narrow portion (22), as shown in FIG. 4, the soft sheets are mutually adhered at a predetermined width across the corner portion (20) to form the corner sealing portion (15). At the small triangular portion (23), the soft sheets are mutually adhered at a portion of a predetermined width of the oblique side to form a jointed sealing portion (24).

The corner sealing portion (15) and the jointed sealing portion (24) are continuous. When the packaging material of the soft sheet used for forming the box body (11) is weldable on the inner face sides of the box body (11) thermally, the corner sealing portion (15) and the jointed sealing portion (24) are welded by a heat sealing method (or a thermal fusing method) using an external heat, an ultrasonic sealing method or a high-frequency sealing method using an induction heat in the resin.

In the small triangular portion (23), as shown in FIG. 4, a non-bonded triangular region (25) is left in the region where the jointed sealing portion (24) is not formed. At this time, both the size of the triangular region (25) projecting from the corner portion (20) and the height size of the triangular region (25) are (W1). This size (W1) is equal to the width size (W1) of the flange portion (16) and the flange portion (17) to be formed later. In short, the triangular region (25) shown in FIG. 4 has the shape of a right-angled isosceles triangle.

In the state shown in FIG. 4, the side face portion (13) and the side face portion (14) are folded outward generally at a right angle, and the triangular regions (25) is developed to form the flange portions (16) and (17) and the flange jointing portion (18) at which the flange portion (16) and the flange portion (17) are jointed, as shown in FIG. 5. In this state of FIG. 5, the flange portion (16), the flange portion (17) and the flange jointing portion (18) are developed in a planar shape parallel to the bottom face portion (12). On the other hand, the jointed sealing portion (24) is extended outward generally at an angle of 135 degrees individually with respect to the two side face portions (13) and (14).

After the flange portion (16), the flange portion (17) and the flange jointing portion (18) were developed in the planar shape, as shown in FIG. 5, and after the box body (11) was charged with the content, the cover member (30) is jointed over the flange portion (16), the flange portion (17) and the flange jointing portion (18) of the box body (11). Alternatively, the cover member (30) may be attached by a step shown in FIG. 3 and FIG. 1A.

According to the process shown in FIG. 3, before the flange portions (16) and (17) are folded from the box body (11), the cover member (30) is folded at its four sides to form a flat face portion (33), folded portions (31, 31) and folded portions (32, 32). The flat face portion (33) of the cover member (30) is given an area equal to or slightly smaller than the opening area of the box body (11). Both the folding width sizes of the folded portions (31, 31) and the folded portions (32, 32) of the four sides of the cover member (30) are the value (W1). On the other hand, a folded portion (34) of a small triangle is formed at the corner between the folded portion (31) and the folded portion (32) of the cover member (30).

As shown in FIG. 3, the cover member (30) thus folded is fitted in the opening of the box body (11) which has been charged with the content. At this time, the folded portions (34) of the cover member (30) are inserted in the triangular regions (25) of the box body (11). This is the state of FIG. 1A. In this state of FIG. 1A, the folded portions (31, 31), and (32, 32) of the cover member (30) are temporarily or wholly adhered to the inner faces of the upper portions of the side face portions (13, 13), and (14, 14). Then, the folded portions (31, 31) of the cover member (30) and the side face portions (13, 13) of the box body (11), and the folded portions (32, 32) of the cover member (30) and the side face portions (14, 14) of the box body (11) are folded outward at a right angle to take the folded width size (W1). As a result, as shown in FIG. 1B, the cover member (30) is developed in a flat shape, and the flange portions (16), the flange portions (17) and the flange jointing portions (18) are developed and formed in the opening of the box body (11). When the cover member (30) is temporarily adhered, the cover member (30) is wholly adhered, after developed as shown in FIG. 1B, to the flange portions (16), the flange portions (17) and the flange jointing portions (18).

Here, the cover member (30) may be adhered by means of an adhesive or welded through the easy peeling type sealant layer, as described hereinbefore. In this case, the cover member (30) can be easily peeled off the box body (11).

Figure 8:
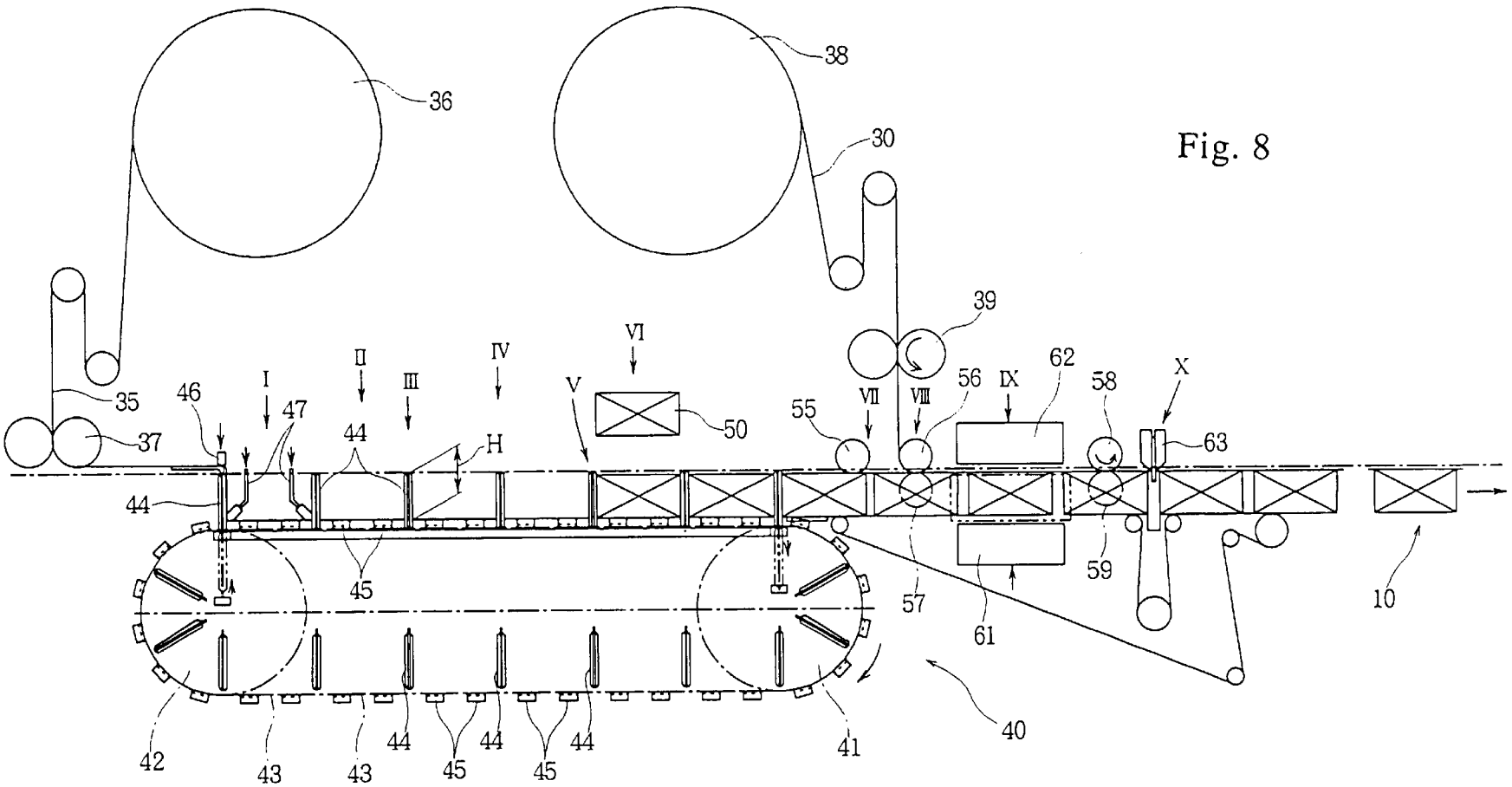
FIG. 8 is a side elevation showing the entire structure of an apparatus for manufacturing a package according to one embodiment of the invention.
Figure 9:
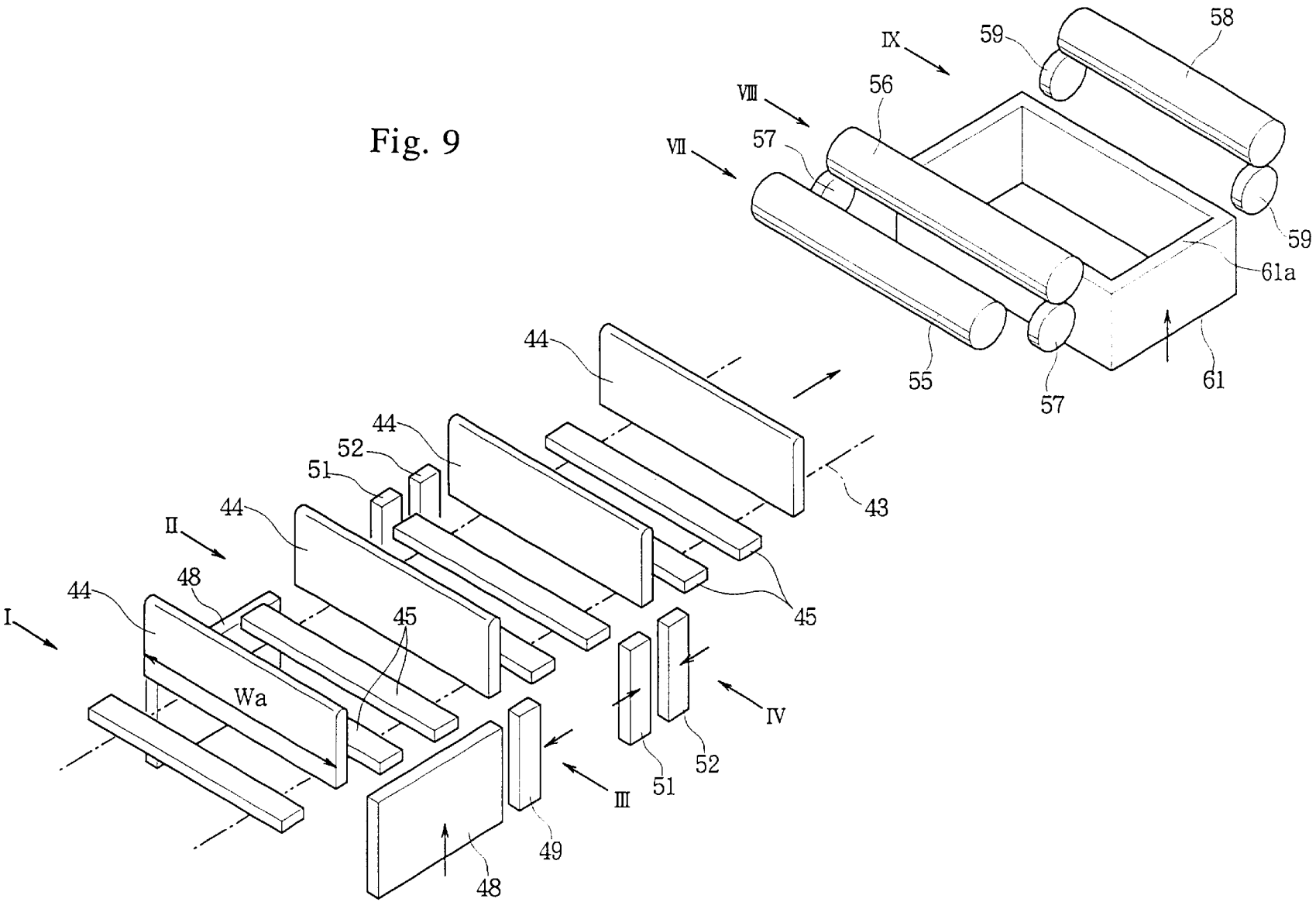
FIG. 9 is a perspective view showing an essential portion of an apparatus for manufacturing a package according to one embodiment of the invention.
Figure 10:
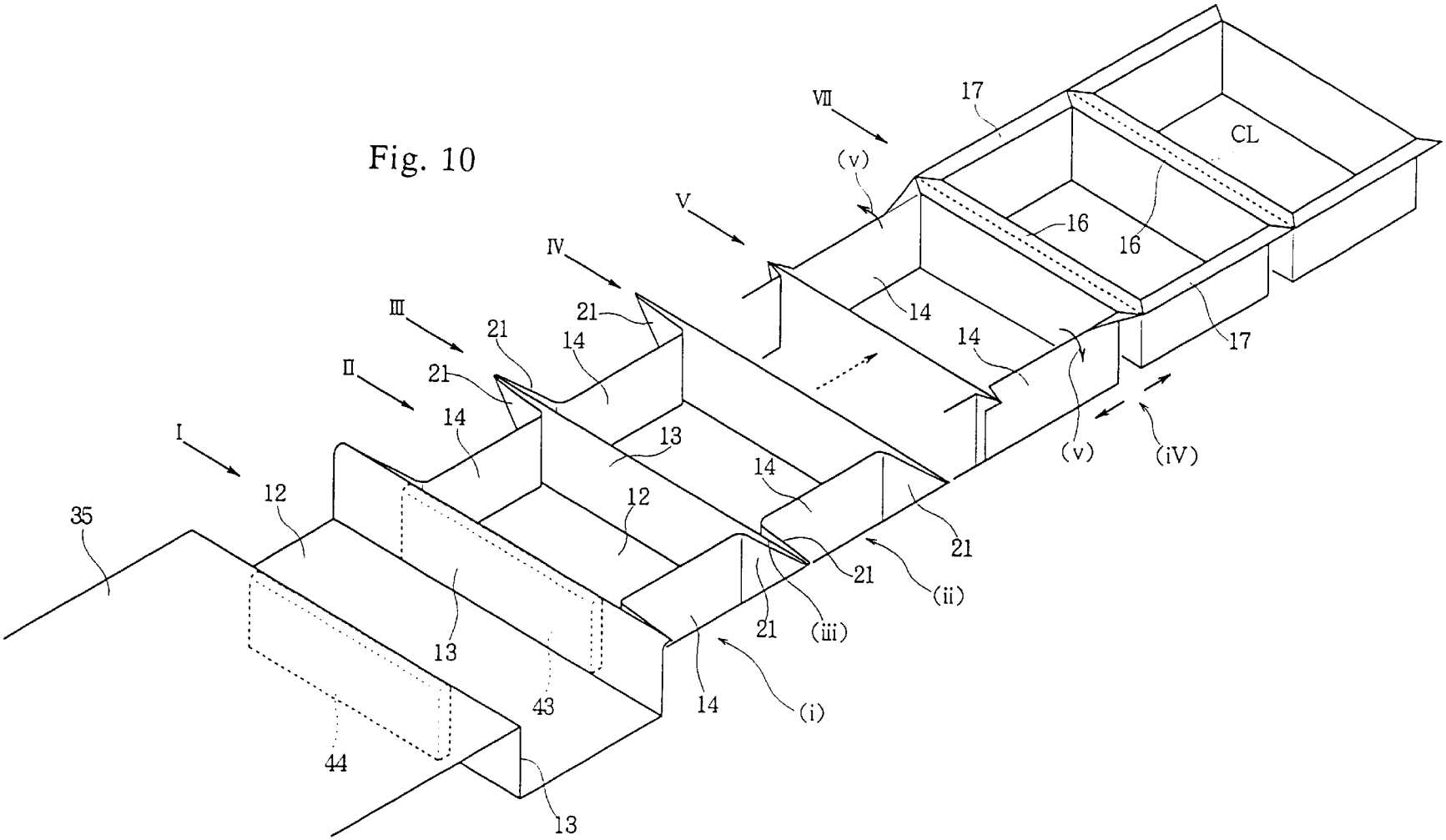
FIG. 10 is a perspective view showing a process in which packages according to one embodiment of the invention are continuously manufactured.
Figure 11:
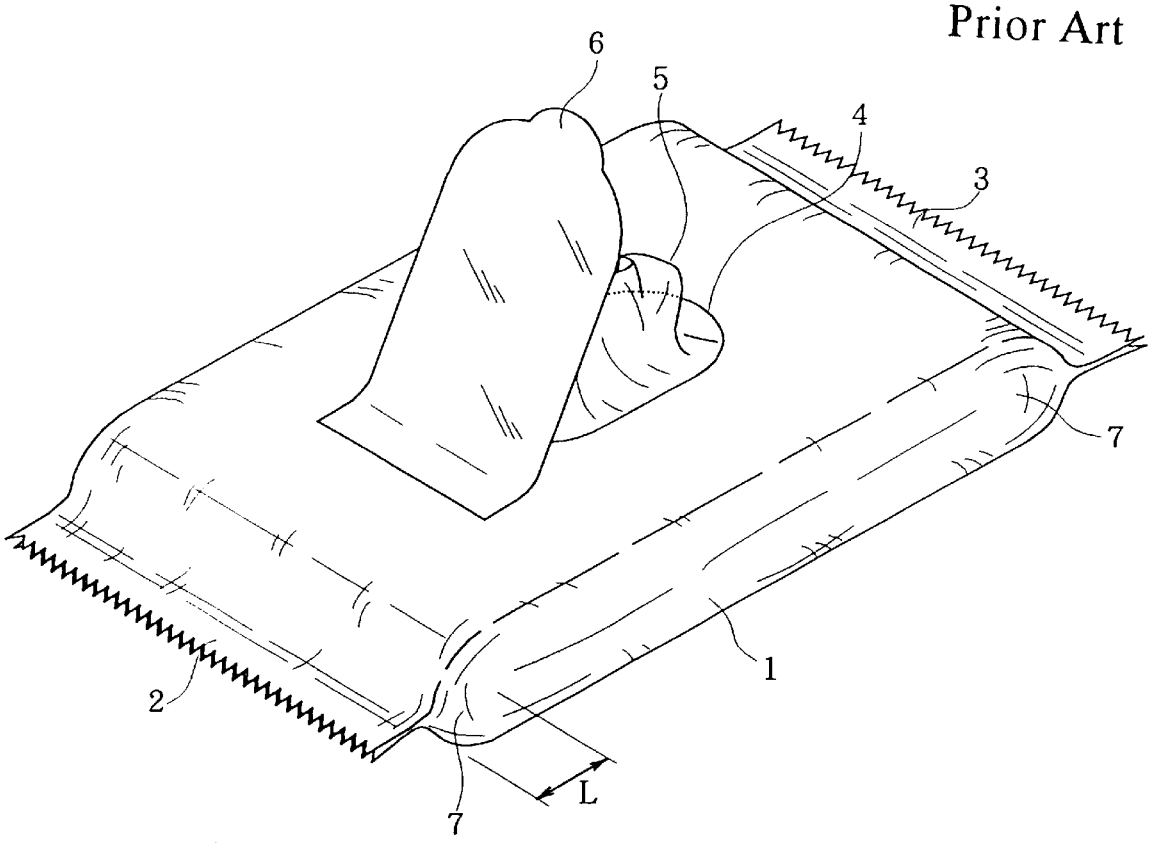
Fig. 11 Prior Art
FIG. 11 is a perspective view showing one example of the package of the prior art, which is formed of a soft sheet.

Next, FIGS. 8 and 9 show one example of an apparatus for continuously manufacturing the package (10). FIG. 8 is a side elevation showing the entirety, and FIG. 9 is a perspective view for explaining the structure of an essential portion. On the other hand, FIG. 10 is a perspective view showing a process for continuously manufacturing the package (10).

A manufacture apparatus (40), as shown in FIGS. 8 and 9, is provided with a chain conveyor (43) which is made to run between a pair of sprockets (41, 42). This chain conveyor (43) is provided with partitions (44) which are spaced at a constant interval. These partitions (44) may always protrude from the chain conveyor (43) but are given, as shown in FIG. 8, a structure in which the running partitions (44) protrude upward only when they move upward of the drawing for the shaping works but retract into the chain conveyor (43) when they run on the lower side without the shaping works. With the partitions (44) having the retracting structure, after the box body (11) was charged with a content (50) at a sixth station (VI) of FIG. 8, the partition (44) can be extracted downward from between the adjoining box bodies (11, 11) to allow the box bodies (11, 11) to be transferred downstream as they are.

To the chain conveyor (43), on the other hand, there are attached a bottom positioning plates (45) which are interposed between the partitions (44, 44). The partition (44) has a width size Wa equal to or larger than that of the side face portion (13) of the longer side of the box body (11). On the other hand, the height (H) of the partition (44) from the bottom positioning plates (45) is equal to the size (h) shown in FIG. 2. This size (h) is the sum of the height of the individual side face portions (13, 14) of the box body (11) and the width size (W1) of the flange portions (16, 17).

A packaging material (35) of a soft sheet for forming the box body (11) is continuously let off from a raw packaging material (36) and is intermittently let off onto the chain conveyor (43) by let-off rollers (37).

At a first station (I), the upstream partition (44) is pushed at its upper end by a push plate (46) so that the packaging material (35) is pushed onto the upper end of the partition (44). Between the partitions (44, 44), moreover, there are interposed a pair of pushers (47, 47) which push the packaging material (35) onto the confronting inner faces of the bottom positioning plates (45) and the partitions (44, 44) so that the packaging material (35) is folded to form the bottom face portion (12) and the side face portions (13, 13) of the longer sides, as shown in FIG. 10.

At a second station (II), while the packaging material (35) being pushed by the same pushers (47, 47) onto the inner faces of the bottom positioning plates (45) and the partitions (44, 44), folding plates (48, 48) (as should be referred to FIG. 9) are raised from the two sides. As a result, as shown in FIG. 10, the packaging material (35) is folded generally at a right angle on the shorter sides of the bottom face portion (12) so that the side face portions (14, 14) are raised to form the folded projecting portions (21) having the shape of the right-angled isosceles triangle.

At a third station (III) located just downstream, temporary sealing plates (49) are forced sideways of the folding plates (48, 48) to clamp the right and left folded projecting portions (21, 21), as formed at the foregoing second station (II), between the folding plates (48) and the temporary sealing plates (49). These temporary sealing plates (49) are exemplified by hot plates, ultrasonic sealing horns or high-frequency oscillation plates to seal the inner faces of the packaging material (35) temporarily at the folded projecting portions (21). By these temporary seals, the inner faces of the packaging material (35) are point-welded only at the regions of the corner sealing portions (15), for example, as shown in FIG. 4.

At a fourth station (IV), the folded projecting portions (21, 21) projecting rightward and leftward are clamped between sealing plates (51, 52) so that the inner faces of the packaging material (35) are welded at the folded projecting portions (21) by the heat sealing, ultrasonic sealing or high-frequency sealing method, like before, to form the corner sealing portions (15) and the jointed sealing portions (24), as shown in FIG. 4.

Here at the third station (III), as shown in FIG. 10, a box body (i) formed upstream and a box body (ii) formed downstream are continuous, and the folded projecting portions (21) of the box body (i) and the folded projecting portions (21) of the box body (ii) are so continuously formed on the two sides of their boundary portions (iii) that they overlap each other. This overlap also occurs in the sealing works at the fourth station (IV).

At the station (III), therefore, the two adjoining folded projecting portions (21, 21) are clamped together between the folding plates (48) and the temporary sealing plates (49). At the fourth station (IV), too, the two folded projecting portions (21, 21) are clamped together between the sealing plates (51, 52).

The packaging material (35), as used to be fed to this apparatus, is a multi-layer sheet material having a weldable layer (or a sealant layer) for the inner face side of the box body (11) and a non-weldable layer for the outer face side of the box body (11). In this case, in the temporary sealing at the third station (III) and in the sealing at the fourth station (IV), the inner faces of the packaging material (35) are sealed to each other at the inner faces of the individual folded projecting portions (21) but not at the outer faces of the adjoining folded projecting portions (21).

At a fifth station (V), as shown in FIG. 8, the folded projecting portions (21) having the corner sealing portions (15) and the jointed sealing portions (24) are cut to leave the narrow portions (22) and the small triangular portion (23) shown in FIG. 4, while eliminating the remaining portions. Here, the cutters are not shown in FIG. 8 and so on.

At the sixth station (VI) shown in FIG. 8, the box body (11) having the narrow portions (22), the small triangular portions (23), the corner sealing portions (15) and the jointed sealing portions (24) formed, as shown in FIG. 4, is charged with the content (50). This content (50) is exemplified by a stack of a plurality of folded tissues. These stacked tissues in the box body (11) are then impregnated with chemicals fed, so that they become wet tissues.

At a next seventh station (VII), a push roller (55) is applied to the upper side of the box body so that the upper portions of the side face portions (14, 14) are folded outwards (v) to form the flange portions (17, 17), as shown in FIG. 10. At a next eighth station (VIII), the cover member (30), as fed from a row packaging material (38), is let off by let-off rollers (39) and is fed onto the box body by a feed roller (56). At this time, the flange portions (17, 17), as folded by the push roller (55), and the cover member (30) are pinched between the feed roller (56) and pinch rollers (57, 57). By making the feeding rate by the feed roller (56) slightly higher than the upstream one, the spacing between the upstream and downstream box bodies is enlarged, as indicated by letters (iv) in FIG. 10, so that the flange portions (16) are formed between the upstream and downstream box bodies.

When the flange portions (16) and the flange portions (17) are developed in a plane, the flange jointing portions (18) are developed and formed at the boundaries between the flange portions (16) and the flange portions (17), as shown in FIG. 5.

Downstream of the portion where the feed roller (56) and the pinch rollers (57, 57) are disposed, there are disposed a feed roller (58) and pinch rollers (59, 59) for applying a feeding force to the flange portions (17, 17) of the box body (11) and the cover member (30).

At a ninth station (IX) between the feed roller (56) and the feed roller (58), moreover, a sealing member (61) ascends from the lower side whereas a sealing member (62) descends from the upper side. As shown in FIG. 9, the lower sealing member (61) is formed into such a frame shape as to place the flange portions (16), the flange portions (17) and the flange jointing portions (18) of the box body (11) on its upper face (61*a*). As a result, the flange portions (16), the flange portions (17) and the flange jointing portions (18), and the cover member (30) are individually clamped between the sealing members (61, 62) so that the box body (11) and the cover member (30) are jointed, for example, by the sealant layer formed on the cover member (30). Here in this case, the sealing operation using the sealing members (61, 62) may be performed by the heat sealing, ultrasonic sealing or high-frequency sealing method.

At a next tenth station (X) shown in FIG. 8, there is vertically disposed a cutting mechanism (63) so that the flange portions (16) and the cover member (30) connecting the adjoining two box bodies (11, 11) are cut along a cutting line CL shown in FIG. 10, to separate the individual packages (10).

In the manufacture apparatus, the box body may be oriented longitudinally or transversely with respect to the transfer direction.

Figure 6A:
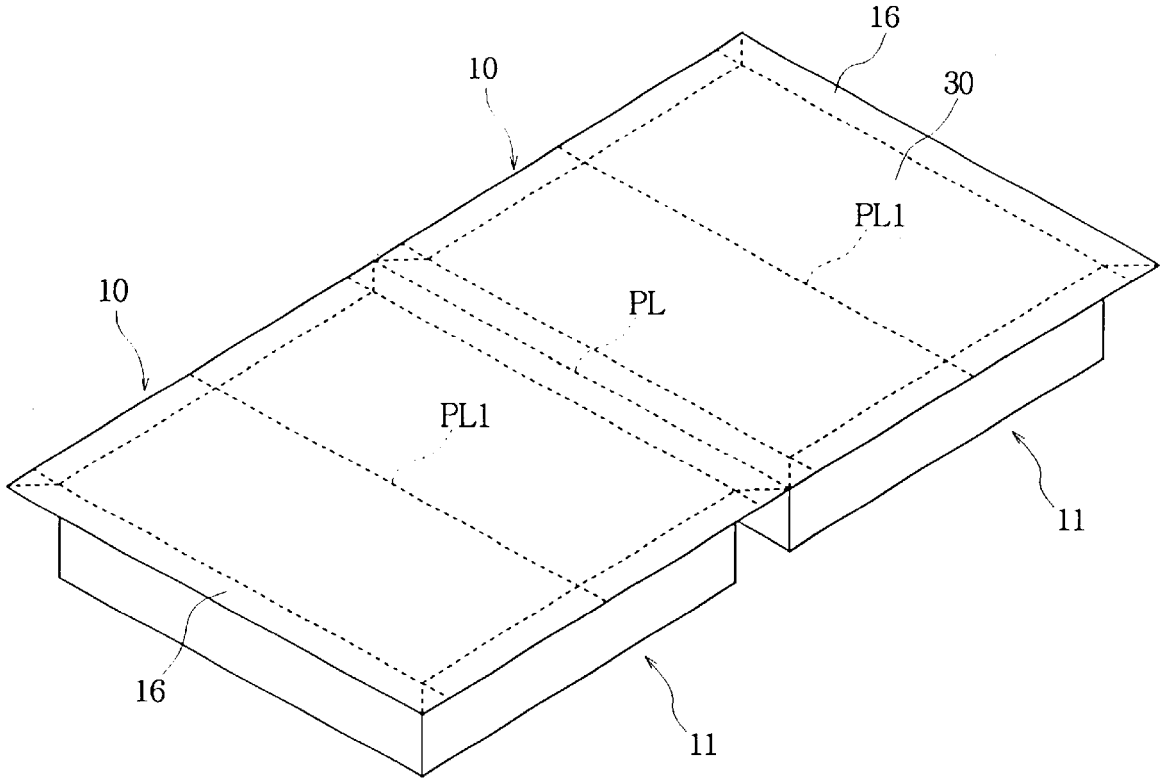
FIGS. 6A and 6B are perspective views showing modifications of the package of FIG. 1B.

Here, as shown in FIG. 6A, two continuous packages (10, 10) can be manufactured by forming perforations (or a perforation line) (PL) at an intermediate portion of the flange portion (16) connecting the box bodies (11, 11) by the cutting mechanism (63). In this case, cutting of the flange portion (16) is performed at every two box bodies (11) by the cutting mechanism (63). In the structure shown in FIG. 6A, the two continuous packages can be commercially sold as a unit, which can be separated into the individual packages (10) when the user cuts it along the perforations (PL).

Here, opening perforations (PL1) may be formed at the central portion of the cover member (30), as shown in FIG. 6A. Then, the cover member (30) can be easily opened by cutting it along the perforations (PL1). In this case, the cover member (30) may be bonded to the flange portions (16), the flange portions (17) and the flange jointing portions (18) by the easy peeling type sealant layer or may be bonded by an ordinary thermal-sealing sealant so that the cover member (30) may not be easily peeled from those flange portions.

Figure 6B:
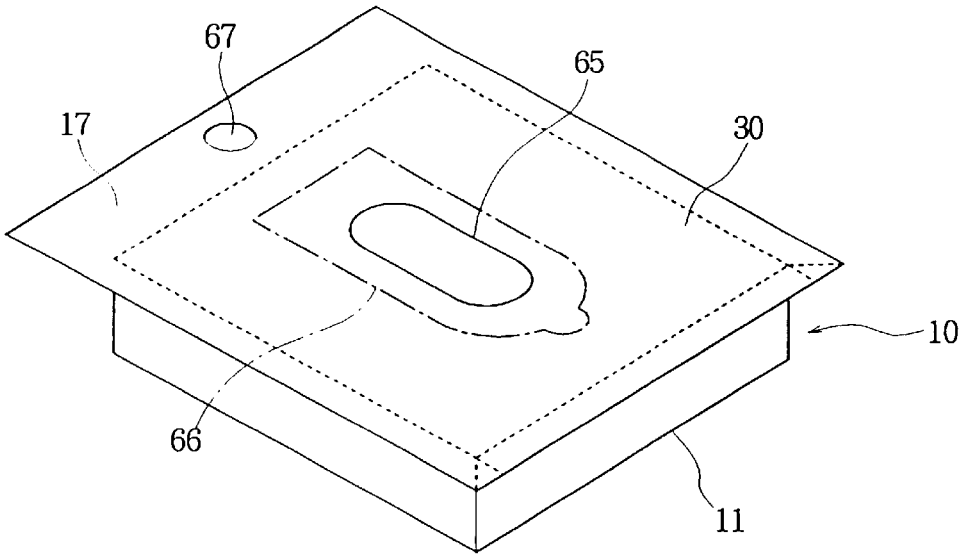

As shown in FIG. 6B, on the other hand, an opening (65) may be formed at the central portion of the cover member (30) for taking out the content therethrough. When the content such as the wet tissues needs a prevention of becoming dry, moreover, it is preferable that the opening (65) is covered with a cover sheet (66), and that the cover sheet (66) is adhered to the surface of the cover member (30) through such an adhesive layer (or sticking layer) that it can be repeatedly separated and stuck.

As shown in FIG. 6B, moreover, one flange portion (17) (and the cover member (30) bonded thereto) may be made wider than the other flange portion so that it can be holed or slotted to form a hook portion (67). With this hook portion (67), the package can be suspended from a hook bar when it is to be displayed. In order to widen one flange portion (17), as shown in FIG. 6B, an extension may be formed integrally with the flange portion (17), for example, in the structure of FIG. 5.

Figure 7:
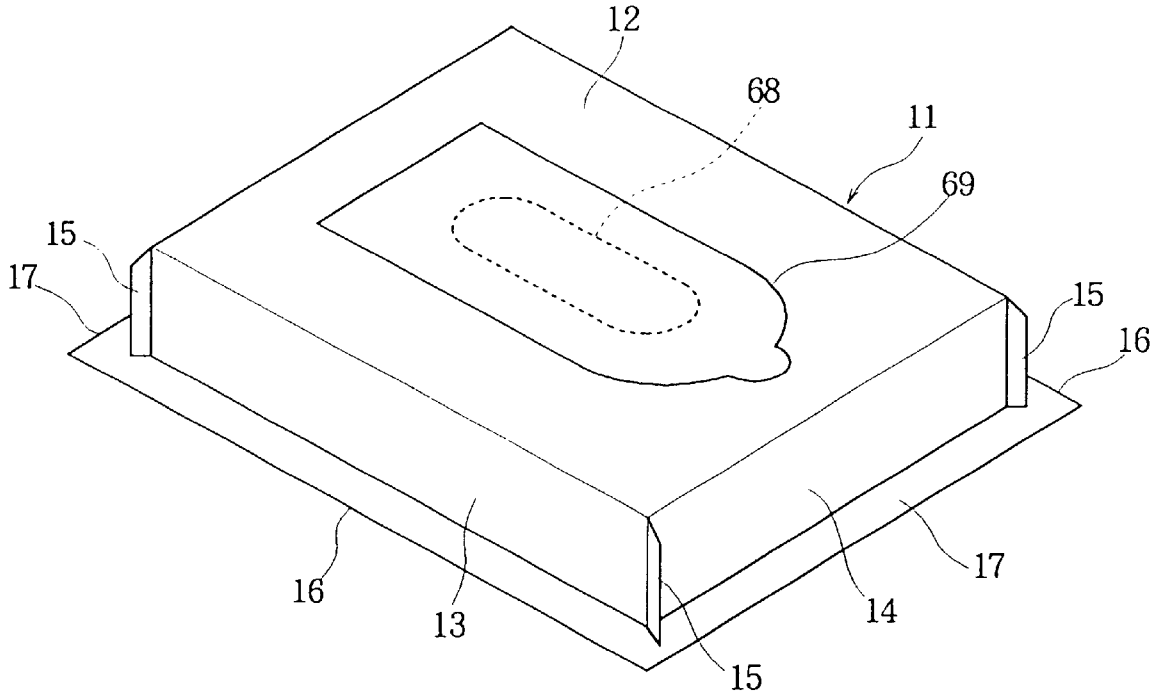
FIG. 7 is a perspective view showing a package in which an opening is formed in a bottom face portion.

Alternatively, such an opening may be formed in the box body (11). In this case, for example, the package may be used with its side closed by the cover member (30) being directed downward, as shown in FIG. 7, and an opening (68) for taking out the content may be formed in the bottom face portion (12). In this case, too, it is preferred that a cover sheet (69) may be so adhered to the bottom face portion (12) as to be repeatedly separated, and that the opening (68) is covered with the cover sheet (69).

As a result of the various structures described in detail above, advantages of the invention may include one or more of the following:

that a package of a soft sheet can have a small outer size while eliminating a wasteful region for packaging a content; and that a package of a soft sheet can be folded or crumpled small when emptied so that it can be prevented from taking a large volume as a waste.

Although various exemplary embodiments have been shown and described, the invention is not limited to the embodiments shown. Therefore, the scope of the invention is intended to be limited solely by the scope of the claims that follow.

What is claimed is:

1. A package comprising a box body having an opening and a cover member for closing the opening of the box body, the box body being formed of a packaging material of a soft sheet having a monolayer of a resin film or a multi-layer structure having a resin film and having:

(a) a rectangular bottom face portion;

(b) four side face portions folded from the four sides of the bottom face portion;

(c) corner sealing portions formed by jointing the inner faces of the side face portions at corner portions between the adjoining side face portions;

(d) flange portions folded outward of the box body from the upper ends of the side face portions substantially at a right angle thereto and with a predetermined width size; and (e) flange jointing portions jointing the flange portions folded from the side face portions without any clearance between each other at the upper ends of the corner portions between the adjoining side face portions, the cover member being formed of a packaging material of a soft sheet having a monolayer of a resin film or a multi-layer structure having a resin film and jointed to the upper surfaces of the flange portions and the flange jointing portions which are formed continuously along the upper ends of the side face portions and the upper ends of the corner portions.

2. The package according to claim 1, wherein the corner sealing portions (c) are formed to extend along the corner portions between the adjoining side face portions with a predetermined width size, and in the flange jointing portions (e), jointed sealing portions are formed continuing to the corner sealing portion, so that each jointed sealing portion extends from the corner portion outward of the box body at an obtuse angle to the respective side face portions adjoining to each other and joins the flange portions of the adjoining side face portions.

3. The package according to claim 1, wherein at least the inner surface of the box body is formed of a weldable packaging material so that the sealing portions are formed by a heat sealing method, an ultrasonic sealing method or a high-frequency sealing method.

4. The package according to claim 1, wherein the packaging material of the soft sheet of the box body is of higher rigidity than the packaging material of the cover member, and the cover member is jointed to the flange portions and the flange jointing portions by an easy peeling type sealant layer.

5. The package according to claim 1, wherein the cover member is formed with perforations along which the cover member can be torn to open the package.

6. The package according to claim 1, wherein the cover member is formed with an opening, and a cover sheet for closing the opening of the cover member is adhered to the surface of the cover member repeatedly separably therefrom.

7. The package according to claim 1, wherein the box body is formed at the bottom face portion with an opening from which the content can be taken out so that the package is to be used while the cover member is directed downward.

8. The package according to claim 7, wherein a cover sheet for closing the opening formed at the bottom face portion is adhered to the surface of the bottom face portion repeatedly separably therefrom.

9. The package according to claim 1, wherein one flange portion folded from any one of the side face portions is larger in width size than the other flange portions, and the flange portion with a larger width size is holed or slotted to form a hook portion.

10. The package according to claim 1, wherein a plurality of box bodies are connected to one another through the flange portions.

11. The package according to claim 2, wherein at least the inner surface of the box body is formed of a weldable packaging material so that the sealing portions are formed by a heat sealing method, an ultrasonic sealing method or a high-frequency sealing method.

* * * * *

UNITED STATES PATENT AND TRADEMARK OFFICE

CERTIFICATE OF CORRECTION

PATENT NO. : 6,273,610 B1
DATED : August 14, 2001
INVENTOR(S) : Yasuhiro Koyama et al.

It is certified that error appears in the above-identified patent and that said Letters Patent is hereby corrected as shown below:

Title page,
Item [73] Assignee, change "Kawanoe (JP)" to -- Ehime (JP) --.

Signed and Sealed this

Fourteenth Day of May, 2002

*Attest:*

*Attesting Officer*

JAMES E. ROGAN
*Director of the United States Patent and Trademark Office*